United States Patent [19]

Kukke

[11] Patent Number: 4,873,804

[45] Date of Patent: Oct. 17, 1989

[54] DRYWALL FRAME COMPRESSION ANCHOR ASSEMBLY AND FRAME

[75] Inventor: Gopal S. Kukke, Manalapan, N.J.

[73] Assignee: Pioneer Industries, Division of Core Industries, Inc., Carlstadt, N.J.

[21] Appl. No.: 256,046

[22] Filed: Oct. 11, 1988

[51] Int. Cl.[4] ..... E06B 1/60

[52] U.S. Cl. ..... 52/217; 52/213; 52/656; 411/116

[58] Field of Search ..... 52/212, 213, 217, 656, 52/211; 411/117, 116, 129

[56] References Cited

U.S. PATENT DOCUMENTS

| | | | |
|---|---|---|---|
| 1,576,068 | 3/1926 | Reznik . | |
| 2,600,072 | 6/1952 | Peremi . | |
| 2,750,213 | 6/1956 | Sale | 411/129 |
| 2,768,410 | 10/1956 | Woodard . | |
| 2,835,933 | 5/1958 | Evans . | |
| 3,156,331 | 11/1964 | Sklar . | |
| 3,222,833 | 12/1965 | Woodrum . | |
| 3,224,152 | 12/1965 | Evans . | |
| 3,265,427 | 8/1966 | Williams . | |
| 3,385,004 | 5/1968 | Oehler et al. . | |
| 3,469,360 | 9/1969 | Peterson et al. . | |
| 3,552,085 | 1/1971 | Woodrum . | |
| 3,570,203 | 3/1971 | Williams | 52/217 |
| 3,571,995 | 3/1971 | Kasprzak . | |
| 3,571,996 | 3/1971 | Braswell | 52/217 |
| 3,721,055 | 3/1973 | Jerchower | 52/217 |
| 4,015,388 | 4/1977 | Hemminger . | |
| 4,118,543 | 10/1978 | Donohue . | |
| 4,139,972 | 2/1979 | Naka . | |

*Primary Examiner*—Carl D. Friedman
*Assistant Examiner*—Caroline D. Dennison
*Attorney, Agent, or Firm*—Amster, Rothstein & Ebenstein

[57] ABSTRACT

A drywall frame compression anchor assembly for use with a sectional metal frame to be mounted in an opening of a wall comprises a restraining bracket having a pair of space support legs and a jamb anchor. The jamb anchor includes a hat section havng a generally U-shaped center portion and a pair of opositely extending wings projecting therefrom. The jamb anchor is moveably mounted between the supports of the spaced support legs to engage the surface of the opening.

23 Claims, 3 Drawing Sheets

DRYWALL FRAME COMPRESSION ANCHOR ASSEMBLY AND FRAME

BACKGROUND OF THE INVENTION

The present invention relates to door frames installed in the opening of a wall, and more particularly to sectional door frames that employ drywall compression anchors.

Generally, sectional door frames consist of a header which is arranged to engage the top of the opening of a wall and a pair of jambs designed to engage opposite marginal side portions of the wall about the opening. The header and the jambs are generally channel shaped in cross section, and the upper ends of the jamb are mitered and connected to mitered opposite ends of the header by a tongue and groove configuration or other known means. One of the jambs constitutes a hinge jamb to which the door is hingeably connected, and the other jamb constitutes a strike jamb against which the swinging edge portion of the door engages.

Sectional door frames are usually installed in the opening of a wall of stud type construction. Walls of this construction are in common use and are known in the industry as "drywalls" in which the wall comprises vertical studding, either wood or metal, with panels formed of plaster board secured to opposite sides of the studs.

Drywall compression anchor assemblies are an inteqral part of the frame component and are used to properly install the sectional door frame at the job site. Typically, these assemblies are located near the upper ends of the jambs and are arranged to seat against or engage the vertical studs, or any other wall surface which delineates the door opening through the use of a jamb anchor which is forced against the studs by a jack screw or similar means. By turning the jack screw, the jamb anchor forces the upper mitered end portions of the jambs toward the opposite mitered ends of the header to provide a secure fit of the frame in the opening. The drywall compression anchor assembly also permits the assembled door frame to be adjusted to a plumb position with reference to the door opening of the wall.

Heretofore drywall compression anchor assemblies have employed jack screws which were supported on only one side of the jamb anchor, typically the jamb side. This single means of support has lead to a variety of problems. For instance, once the jamb anchor reaches the end of the screw, the screw had a tendency to tip to one end which prevented the jamb anchor and the wall from engaging in surface to surface contact. As a result, the pressure exerted between the wall and jamb anchor was not uniform during installation. Additionally, once the jamb anchor reaches the end of the screw, there was the possibility that the jamb anchor would disengage from the assembly. In such case the jamb anchor would fall into the door opening between the wall and the door frame necessitating removal of at least a portion of the door frame to retrieve and reinstall the jamb anchor.

U.S. Pat. Nos. 2,835,933; 3,469,360 and 3,552,085 disclose prior art drywall compression anchor assemblies each having the shortcomings described above.

Accordingly, it is an overall object of the present invention to provide a drywall compression anchor assembly which will exert uniform pressure against the wall opening by making solid surface contact between the wall and the jamb anchor.

It is another object to provide such an apparatus that prevents the jamb anchor from disengaging from the apparatus when the jamb anchor travels to the end of the jack screw.

A still further object of the present invention is to provide such an apparatus in which the jack screw is supported on both sides of the jamb anchor.

A still further object is to provide such an apparatus which prevents the screw from tipping to one end when the jamb anchor travels to the end of the screw.

A still further object is to provide such an apparatus to capture the jamb anchor between a pair of supports.

A still further object is to provide such an apparatus that is of simple and economical construction, easy to use and inexpensive to manufacture.

SUMMARY OF THE INVENTION

It has now been found that the above and related objects of the present invention are attained in a drywall compression anchor assembly for use with a frame to be mounted in an opening of a wall comprising a support means having a pair of spaced support legs and a jamb anchor including a center portion and a pair of oppositely extending wings projecting therefrom. The jamb anchor is moveably mounted between the supports to engage the surface of the opening. Preferably the means for moving the jamb anchor between the support legs include screw means including a head and a shank portion. The shank portion is arranged in threaded engagement with the center portion and is supported by each of the support legs on opposite sides of the center portion. Rotation of the screw means causes the jamb anchor to travel along the shank portion between the support legs.

In a preferred embodiment, the drywall compression anchor assembly includes the jamb anchor having a hat section including a generally U-shaped center portion, and means to restrict the jamb anchor from rotating. Preferably the means to restrict the jamb anchor from rotating includes the second support leg. Further, the second support leg and a relieved portion of the first support leg include openings formed therein to receive and support the shank portion.

In a preferred embodiment, the head of the screw includes means to prevent the head from passing through the opening of the first support leg. Preferably, the means includes a shoulder having an effective diameter greater than the diameter of the opening in the first support leg.

Preferably the frame used in conjunction with the drywall compression anchor assembly comprises a header arranged to be mounted in a horizontal position across the top of the opening, and a pair of jambs arranged to be mounted in a vertical position along opposite sides of the opening. Adjoining ends of the header and the jamb interfit one another upon installation in the opening, and means to interconnect the adjoining ends of the header and the jambs are employed.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing wherein similar reference numerals denote similar elements throughout the several figures.

DETAILED DESCRIPTION OF THE PREFERRED EMBODIMENTS

Figure 1:
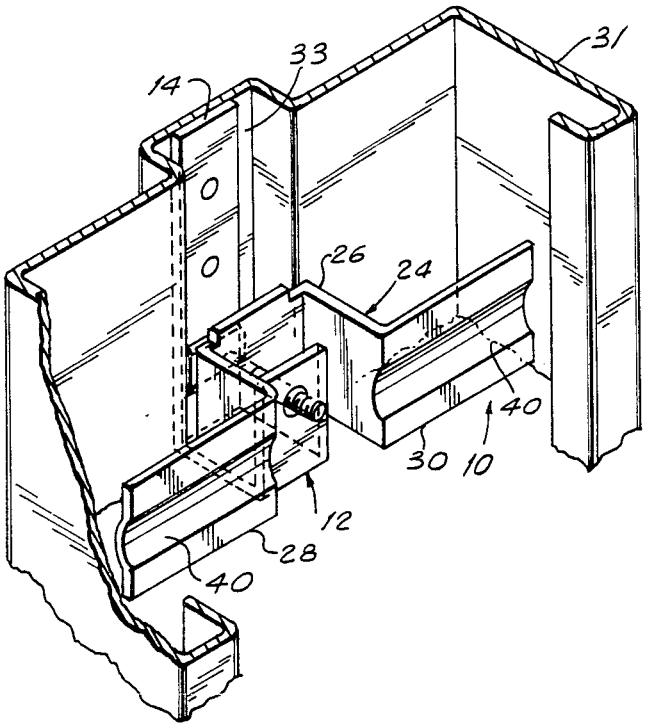
FIG. 1 is a partially broken away perspective view of a dry wall compression anchor assembly according to the present invention.
Figure 2:
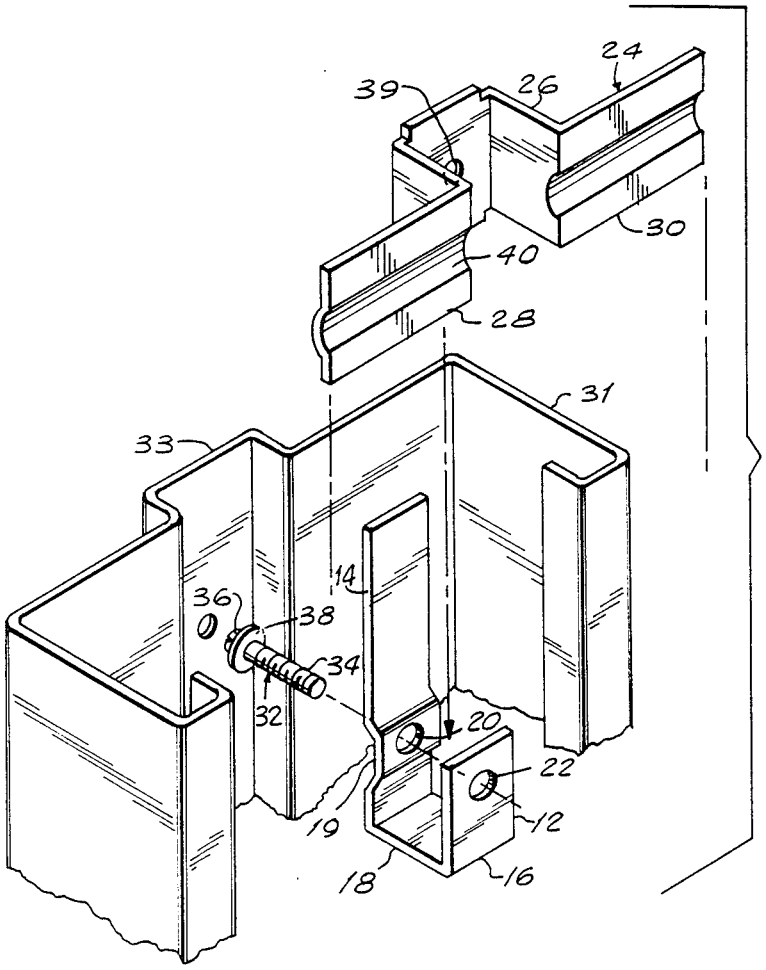
FIG. 2 is a partially broken away exploded, perspective view of the dry wall compression anchor assembly.

Referring now to the drawing, and in particular to FIGS. 1 and 2 thereof, therein illustrated is a drywall compression anchor assembly incorporating one embodiment of the present invention generally designated by the reference numeral 10. The anchor assembly 10 comprises a restraining bracket o yoke 12 having a first support leg 14, a second support leg 16 and a cross web 18 joining the two support legs. The first support leg 14 includes a relieved section 19 having an opening 20 formed therethrough. The second support leg 16 includes an opening 22 formed therethrough axially aligned with the opening 20.

A jamb anchor 24 is moveably mounted between the first support leg 14 and the second support leg 16. The jamb anchor 24 includes a hat section having a generally U-shaped center section 26, and a pair of oppositely extending wings 28, 30 projecting therefrom. As shown in FIG. 1, and as will be more fully discussed below, the anchor assembly 10 is fixed to the upper end of the inside surface of a door jamb 31 by mechanical fastening means such as spot welding the first support leg 14 to the inside surface of a hollow door stop portion 33 of the door jamb 31.

The jamb anchor 24 is moveably mounted between the support legs 14, 16 by means of a jack screw 32 having a shank portion 34 and a head 36 including a shoulder 38. The shoulder 38 has a diameter greater than the diameter of opening 20 to prevent the head 36 from passing therethrough.

It is preferred that the yoke 12 and the jamb anchor 24 be fabricated of thin gage steel. It will be appreciated by those skilled in the art that the wings 28, 30 of the jamb anchor 24 can be reinforced with stiffening ribs 32 and that the U-shaped center portion can be reinforced with similar stiffening ribs (not shown) for increased stiffness and strength. The stiffening ribs 40 allow greater engagement forces to be asserted by the wings 28, 30 when pressed against a wall during installation as will be more fully discussed below. The yoke 12 can also be reinforced with stiffening ribs for similar reasons.

Referring now to FIG. 2, to assemble the drywall compression anchor assembly 10, the jamb anchor 24 is first positioned between the support legs 14, 16 so the openings 20, 22 are axially aligned with a threaded opening 39 in the U-shaped center portion 26 of the jamb anchor 24. The shank portion 34 of the screw 32 is then passed through the opening 20 until it is threaded into the opening 39 in the U-shaped center portion 26 of the jamb anchor 24. The screw 32 is then turned further until the end of the shank portion 34 passes through opening 22 of the second support leg 16. Openings 20, 22 of support legs 14, 16 now support the shank portion 34 of the screw 32 on opposite sides of the U-shaped center portion 26 of the jamb anchor 24.

The pitch of the threads on the shank portion 34 of the screw 32 is identical to the pitch of the opening 39. Thus as screw 32 is rotated clockwise, the jamb anchor 24 moves in one direction. To create the threaded opening 39, it is recommended that the opening 39 be coined and split at one location on the circumference. The split ends are then twisted to form the same pitch and hand of the shank portion 34 which is provided with left hand threads to facilitate the most common principle of tightening by clockwise rotation. This method eliminates the additional operation of threading the jamb anchor 24. As a result, the jamb anchor 24 is able to travel or ride on the shank portion 34 of the screw 32.

Figure 3:
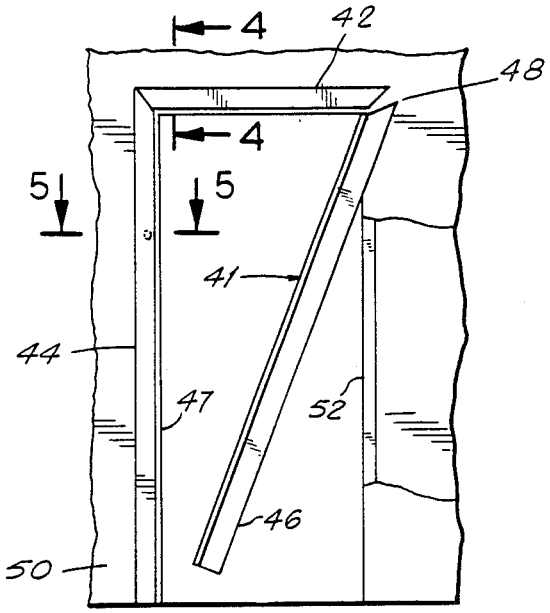
FIG. 3 is a side elevation view of a sectional door frame partially installed in an opening of a wall.

Referring now to FIG. 3, a sectional door frame 41, which embodies the assembly 10 of the present invention, is manufactured of sheet metal or the like and includes a header 42 and vertical jambs 44, 46, one constituting a hinge jamb, and the other a strike jamb. The ends of the header 42 and the upper ends of the jambs 44, 46 are mitered in the conventional way, as at 48, to interfit one another upon assembly of the frame 41 within a door opening. The header 42 and the jamb 44 each include a hollow door stop portion 47 delineating the frame 41, and are identical in cross section, each jamb having a generally channel shaped cross-section.

The frame 41 is installed in the door opening by engaging a wall 50 of stud type construction. Walls of this construction are in common use and are known in the industry as "drywalls" in which the wall comprises vertical studding 52, usually manufactured of either wood or metal, with panels 54 (FIGS. 4–6) formed of plaster board secured to opposite sides of the studding 52. The vertical studding 52 and a horizontal cross-stud (not shown) delineate or frame the door opening. Sectional door frames can also be installed in the external wall of a building such as one of masonry construction (not shown). The sectional frame structure is also intended for use as a window frame utilizing the same general principles of construction and installation.

Referring now to FIGS. 3–6, the assembly 10 is shown located near the upper end of the jamb 44 spaced downwardly from the header 42 as shown. Another assembly 10 is to be located near the upper end of jamb 46 spaced downwardly from the header 42, not shown. The assembly 10 is arranged to engage or seat against the vertical studs 52, or any other wall surface which frames the door opening to secure and plumb the sectional frame 41 in the door opening.

Figure 5:
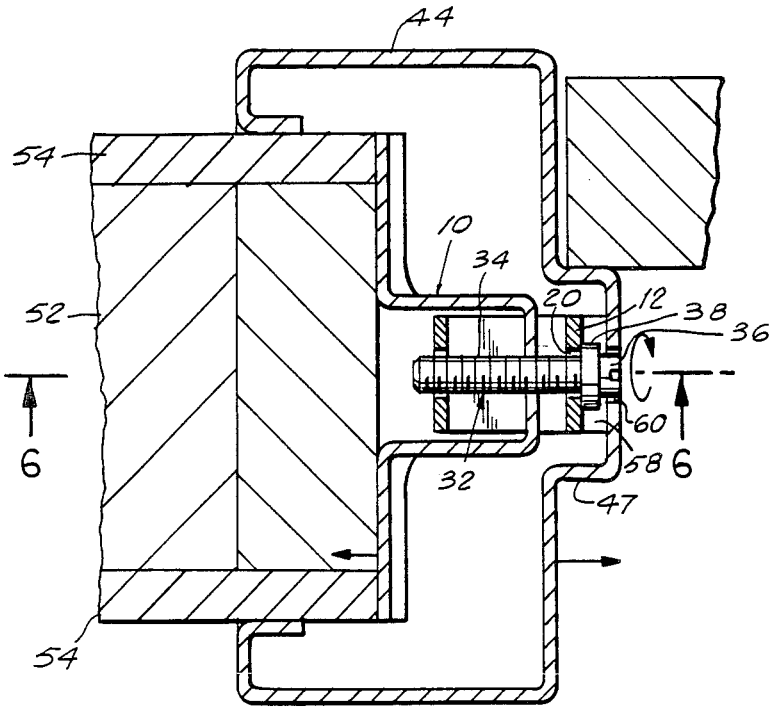
FIG. 5 is a sectional view of FIG. 3 taken along line 5—5 of FIG. 3.
Figure 6:
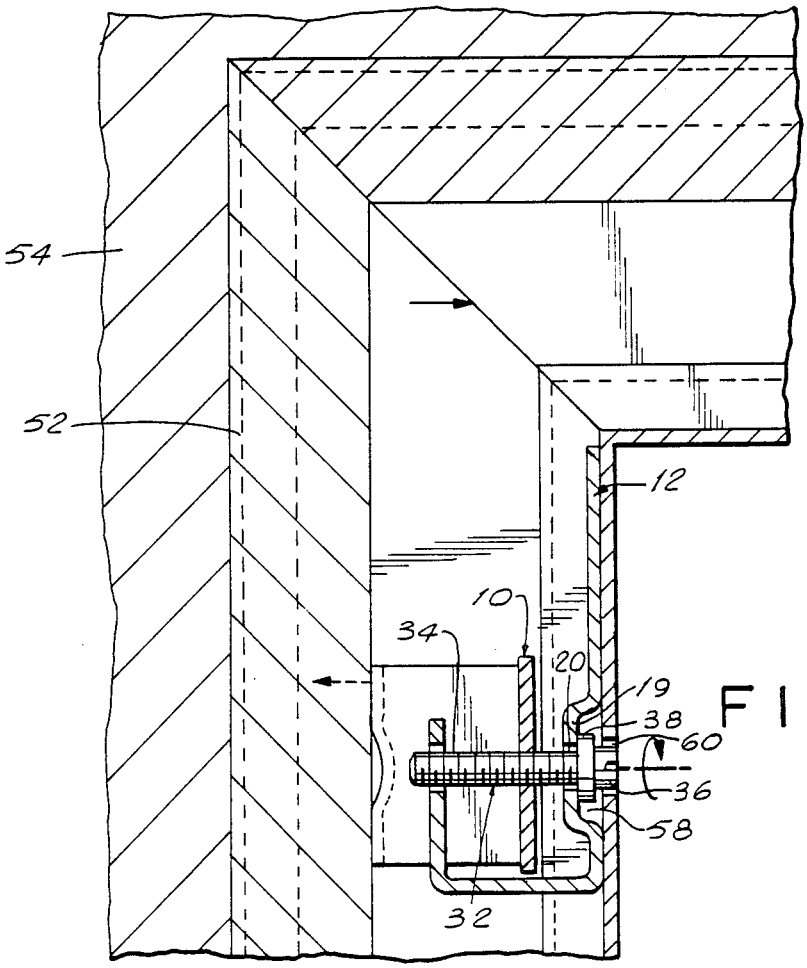
FIG. 6 is a sectional view of FIG. 5 taken along line 6—6 of FIG. 5.

Referring now to FIGS. 5 and 6, the assembly 10 is shown secured to the inside surface of the hollow door stop portion 47 of the jamb 44. The assembly 10 is secured by spot welding the first support leg 14 of the yoke 12 to the inside surface of the hollow door stop portion 47, although other means known to those skilled in the art can be employed.

The relieved portion 19 of the first support leg 14 is offset from the surface of the hollow door stop portion 47 to provide a space 58 or clearance between the inside surface of the relieved portion 19 and the inside surface of the hollow door stop portion 47 when the first support leg 14 is secured to the inside surface of the hollow door stop portion 47. The shoulder 38 of the screw 32 has a diameter greater than the diameter of the opening 20 in the relieved section 19, and a diameter greater than an opening 60 in the hollow door stop portion 47 which is axially aligned with the openings 20, 22. Thus, screw 32 is rotatably retained within the space 58, and prevented from moving longitudinally. The head 36 of the screw 32 projects outwardly through the opening 60 for engagement with a tool, such as a screwdriver. If a screwdriver is to be used, then the head 36 should be slotted to engage the end of a screwdriver. It is recommended that the outer surface of the head 36 be flush with the outer surface of the hollow door stop portion 47. If desired, once the door frame 41 is installed, the opening 60 can be sealed over by soldering or the like to conceal the head 36.

As best shown in FIGS. 5 and 6, the jamb anchor 24 is captured between the support legs 14, 16 of the yoke 12 thereby preventing the jamb anchor 24 from being disengaged from the assembly 10. Likewise, the screw 32 is also supported by support legs 14, 16 at two positions on opposite sides of the jamb anchor 24. This prevents the screw 34 from tipping when the jamb anchor travels towards the end of the shank portion 34 of the screw 32. In jamb anchor compression assemblies of the prior art which do not employ a second support leg 16 on the stud side of the jamb anchor, when the jamb anchor travels as far as it will go on the screw, the screw tips in a downward direction. As a result, the jamb anchor and the wall are not in surface-to-surface contact and the pressure exerted between the wall and the jamb anchor is not uniform during installation of the door frame. Further, when the jamb anchor approaches the end of the screw there is always a risk that if the screw is overturned, the jamb anchor will become disengaged from the entire assembly. This can occur, for example, if the opening in the dry wall is too large, or through improper or inadvertent handling of the frame or drywall compression anchor assembly.

Figure 4:
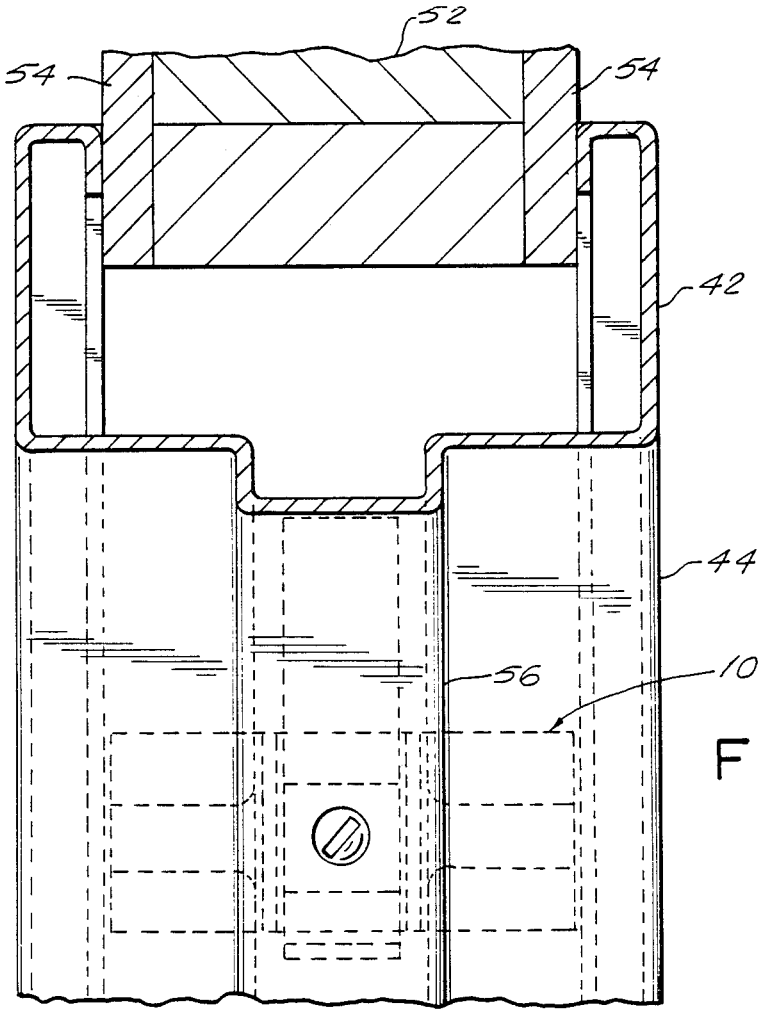
FIG. 4 is a sectional view of FIG. 3 taken along line 4—4 of FIG. 3.

To install the frame 41 in the wall 50, the header 42 is first placed across the top of the door opening and is preferably held in place by frictional engagement with the opposite marginal surfaces of the wall panels 54 (FIGS. 4–6). After the header 42 is installed, the mitered end of one of the door jambs (e.g., jamb 46 in FIG. 3) is pivotally connected to the appropriate mitered end of the header 42 by means of a hinge arrangement, tongue and groove or by any other means known in the art.

After having been pivotally connected, the jamb is pivoted toward its vertical position, frictionally engaging the opposite surfaces of the wall panels 54 (FIGS. 4–6) marginally about the door opening. Thereafter the opposite jamb (e.g., jamb 44 in FIG. 3) is connected to the header 42 in the same manner and pivoted toward its vertical position (not shown) also engaging the opposite marginal surfaces of the wall panels 54 (FIGS. 4–6) marginally about the door opening.

Once the sectional door frame 40 is squared in the opening of the wall 50 as described above, the head 36 of the screw 32, projecting outwardly from the opening 60 in the hollow door stop portion 47, is turned through the use of a tool such as a screwdriver. Preferably screw 32 is left hand threaded and is therefore if turned clockwise to tighten the jamb anchor 24. As the screw 32 is rotated clockwise, the jamb anchor 24 travels on the shank portion 34 of the screw 32 until the wings 28, 30 of the jamb anchor 24 engage the vertical stud 52, or the wall surface, and apply a compressive force against the vertical stud 52, or the wall surface. The wings 28, 30 should be of a sufficient length to at least span the entire width of the stud 42.

When the screw 32 is rotated, the jamb anchor 24 is prevented from spinning by the second support leg 16 which blocks the rotational path of the jamb anchor 24 by engaging the jamb anchor 24.

Upon further rotation of the screw 32, the shoulder 38 of the screw 32 engages the inside surface of the hollow door stop portion 47 to force the upper mitered end portions of the jamb 44 away from the stud 52, or the wall surface, and toward the opposite mitered ends of the header 42 which forces the header 42 upwardly. This secures the sectional frame 41 in the door opening. Movement of the upper mitered end portions of the jamb 44 by further rotation of the screw 34 serves to adjust jamb 44 to a plumb or vertical position with reference to the opening of the wall 50. Similarly, an assembly 10, which is embodied in opposite jamb 46 (not shown), is rotated to further secure the frame 41 in the door opening and to adjust jamb 46 to a plumb or vertical position with reference to the opening of the wall 50.

The drywall compression anchor assembly of the present invention exerts uniform pressure against the wall opening by making solid surface contact between the wall and the jamb anchor. A pair of support legs support the screw on both sides of the U-shaped center portion of the jamb anchor, and capture the jamb anchor between the support legs. This construction prevents the jamb anchor from disengaging from the drywall compression anchor assembly when the jamb anchor travels to the end of the screw. The anchor assembly is of simple and economical construction, easy to use and is inexpensive to manufacture.

Now that the preferred embodiments have been shown and described in detail, various modifications and improvements thereon will become readily apparent to those skilled in the art. Accordingly, the appended claims are to be construed broadly and in a manner consistent with the spirit and scope of the present invention.

What I claim is:

1. A drywall frame compression anchor assembly for use with a frame to be mounted in an opening of a wall, comprising:

support means having a pair of spaced support legs;

a jamb anchor including a center portion and a pair of oppositely extending wings projecting therefrom, said jamb anchor moveably mounted between said support legs; and means for moving said jamb anchor between said support legs to engage the surface of an opening of a wall including a threaded opening in said center portion of said jamb anchor and screw means having a head and a shank portion, said shank portion arranged in threaded engagement with said threaded opening in said center portion and supported by an opening in at least one of said support legs so that upon rotation of said screw means, the jamb anchor travels along said shank portion between said support legs.

2. The drywall frame compression anchor assembly of claim 1 wherein said jamb anchor includes a hat-section having a generally U-shaped center portion.

3. The drywall frame compression anchor assembly of claim 2 wherein said screw means is supported by said pair of support legs on opposite sides of said U-shaped center portion.

4. The drywall frame compression anchor assembly of claim 1 wherein said support means includes a yoke having said first support leg and said second support leg spaced therebetween and joined by a cross-web.

5. The drywall frame compression anchor assembly of claim 4 wherein said first support leg includes a relieved portion formed therein.

6. The drywall frame compression anchor assembly of claim 5 wherein said second support leg and said relieved portion of said first support leg include an opening formed therein to receive and support said shank portion.

7. The drywall frame compression anchor assembly of claim 1 further comprising:

means to restrict the jamb anchor from spinning when said screw is rotated.

8. The drywall frame compression anchor assembly of claim 7 wherein said means to restrict the jamb anchor from rotating includes said second support leg.

9. The drywall frame compression anchor assembly of claim 1 wherein said head includes means to prevent said head from passing through an opening of said first support leg.

10. The drywall frame compression anchor assembly of claim 9 wherein said to prevent means includes a shoulder having a width greater than the width of said opening of an first support leg.

11. The drywall frame compression anchor assembly of claim 1 wherein the frame comprises:

a header arranged to be mounted in a horizontal position across the top of the opening;

a pair of jambs arranged to be mounted in a vertical position along opposite sides of the opening;

adjoining ends of said header and said jamb interfitting one another upon installation in the opening; and means to interconnect said adjoining ends of said header, and said jambs.

12. A frame arranged to be mounted in an opening of a wall comprising:

a header arranged to be mounted in a horizontal position across the top of the opening;

a pair of jambs arranged to be mounted in a vertical position along opposite sides of the openings, each jamb including a hollow door stop portion formed along the lengths therein and an opening formed in at least one of said portions;

adjoining ends of said header and said jambs interfitting one another upon installation in the opening; and means to interconnect said adjoining ends of said header and said jambs including an anchor assembly secured to the inner surface of said hollow door stop portion of at least one of said jambs, said anchor assembly including support means having a pair of support spaced legs each including an opening formed therein, said first support leg including a relieved portion relieved away from the inside surface of said hollow door stop portion; a jamb anchor moveably mounted between said support legs including a hat section having a generally U-shaped center portion with a pair of oppositely extending wings projecting therefrom, said center portion having a width less than the width of said door stop portion; screw means including a head, a shank portion, and means for abutting the inside portion of said hollow door stop portion, said head arranged to be exposed for tool engagement at the outside surface of said door jamb through said opening formed in said hollow door stop portion, and said shank portion arranged in threaded engagement with the U-shaped center portion and supported by said pair of support legs on opposite sides of the U-shaped center portion such that upon rotation of said screw, said jamb anchor being restricted from spinning by said second support leg travels along said shank portion between said support legs and is forced into engagement with the surface of the opening to force the adjoining ends of said header and said jamb into forceable mating engagement.

13. The frame of claim 12 wherein said means for abutting the inside portion of said hollow door stop portion includes a shoulder portion of said head having a width greater than the width of said opening formed in said hollow door stop portion.

14. The frame of claim 13 wherein said shoulder portion has a width greater tan the width of said opening in said first support leg.

15. The frame of claim 12 wherein said support legs are joined by a cross web having a length greater than the depth of said hollow door stop portion.

16. The frame of claim 12 wherein said anchor assembly further includes means to adjust said jamb to a plumb position with reference to the wall opening.

17. A drywall frame compression anchor assembly for use with a frame to be mounted in an opening of a wall comprising:

support means including a pair of spaced support legs each having an opening formed therein, said first support leg including a relieved portion formed therein;

a jamb anchor mounted between said support legs including a hat section having a generally U-shaped center portion with a pair of oppositely extending wings projecting therefrom; and screw means including a head portion and a shank portion, said head portion including means for tool engagement, and said shank portion arranged in threaded engagement with the U-shaped center portion and supported by said pair of support legs on opposite sides of said U-shaped center portion such that upon rotation of said screw, said jamb anchor being restricted from spinning by said second support leg travels along said shank portion between said support legs.

18. The drywall frame compression anchor assembly of claim 17 wherein said head includes means to prevent said head from passing through said opening in said first support leg.

19. The drywall frame compression anchor assembly of claim 18 wherein said means to prevent includes a shoulder portion having a width greater than the width of said opening in said first support leg.

20. The drywall frame compression anchor assembly of claim 18 wherein said means to prevent includes said head having a width greater than the width of said opening formed in said first support leg.

21. A drywall frame compression anchor assembly for use with a frame to be mounted in an opening of a wall comprising:

a jamb anchor including a center portion and a pair of oppositely extending wings projecting therefrom;

screw means including a head and a shank portion, said shank portion arranged in threaded engagement with said center portion; and support means for supporting said screw means on opposite sides of said center portion so that upon rotation of said screw means, said jamb anchor travels along said shank portion between said support means wherein said support means includes a yoke having a first support leg and a second support leg spaced therebetween and joined by a cross-web, at least one of said support legs includes an opening formed therein to receive and support said shank portion.

22. The drywall frame compression anchor of claim 21 wherein said jamb anchor includes a hat section having a generally U-shaped center portion.

23. The drywall frame compression anchor of claim 21 wherein upon rotation of said screw means, said second support leg prevents said jamb anchor from spinning.

* * * * *